US005718805A

United States Patent [19]

Egelhof et al.

[11] Patent Number: 5,718,805

[45] Date of Patent: *Feb. 17, 1998

[54] TWIN WIRE FORMER

[75] Inventors: Dieter Egelhof; Klaus Henseler, both of Heidenheim, Germany; Werner Kade, Neenah, Wis.; Albrecht Meinecke, Heidenheim, Germany; Wilhelm Wanke, Heidenheim, Germany; Hans-Jurgen Wulz, Heidenheim, Germany; Rudolf Bück, deceased, late of Heidenheim, Germany, by Else Bück, legal representative

[73] Assignee: J. M. Voith GmbH, Heidenheim, Germany

[ * ] Notice: The term of this patent shall not extend beyond the expiration date of Pat. No. 5,500,091.

[21] Appl. No.: 556,769

[22] Filed: Nov. 2, 1995

Related U.S. Application Data

[63] Continuation of Ser. No. 286,948, Aug. 8, 1994, Pat. No. 5,500,091, which is a continuation of Ser. No. 55,918, Apr. 29, 1993, Pat. No. 5,389,206, which is a continuation of Ser. No. 773,965, filed as PCT/EP90/01313, Sep. 8, 1990, abandoned.

[30] Foreign Application Priority Data

Aug. 22, 1989 [DE] Germany ..... 39 27 597.3

[51] Int. Cl.[6] ..... D21F 1/00

[52] U.S. Cl. ..... 162/301; 162/300

[58] Field of Search ..... 162/203, 300, 162/301, 303, 348, 352

[56] References Cited

U.S. PATENT DOCUMENTS

| | | | |
|---|---|---|---|
| 3,994,774 | 11/1976 | Halme et al. | 162/301 |
| 4,425,187 | 1/1984 | Armstrong et al. | 162/300 |
| 4,532,008 | 7/1985 | Creagan et al. | 162/203 |
| 4,609,435 | 9/1986 | Tissari | 162/352 |
| 4,769,111 | 9/1988 | Nevalainen et al. | 162/351 |
| 4,917,766 | 4/1990 | Koivuranta et al. | 162/301 |
| 4,925,531 | 5/1990 | Koski | 162/301 |
| 5,078,835 | 1/1992 | Schiel et al. | 162/352 |
| 5,185,064 | 2/1993 | Nyman | 162/301 |
| 5,389,206 | 2/1995 | Buck et al. | 162/301 |
| 5,500,091 | 3/1996 | Buck et al. | 162/301 |

FOREIGN PATENT DOCUMENTS

| | | | |
|---|---|---|---|
| 0289445 | 4/1988 | European Pat. Off. . | |
| 0296135 | 6/1988 | European Pat. Off. . | |
| 0306759 | 8/1988 | European Pat. Off. . | |
| 3138133 | 9/1981 | Germany . | |
| 3321406 | 6/1983 | Germany . | |
| 3329833 | 8/1983 | Germany . | |
| 3628282 | 8/1986 | Germany . | |
| 8806036.5 | 5/1988 | Germany . | |
| 1125906 | 10/1965 | United Kingdom . | |
| 8604368 | 7/1986 | WIPO . | |
| 9102842 | 3/1991 | WIPO | 162/301 |

OTHER PUBLICATIONS

Tappi Press "1989 Twin-Wire Seminar", Washington Hilton, Washington, D.C., Apr. 12–14, 1989, pp. iii, 103–114.

*Primary Examiner*—Karen M. Hastings

*Attorney, Agent, or Firm*—Ostrolenk, Faber, Gerb & Soffen, LLP

[57] ABSTRACT

In a twin-wire former for the production of a paper web, two wire belts (11 and 12) together form a twin-wire zone which is divided into three sections (I, II and III). In the first section (I) the two wires (11, 12) travel over a curved forming shoe (16), or a forming roll (40). They form there a wedge-shaped inlet slot (15) with which a headbox (10) is directly associated. In the second section (II), several resiliently supported strips (27) rest against the lower wire (11) and between each of said strips (27) a rigidly mounted strip (28) rests against the upper wire (12). In the third section (III) both wire belts (11, 12) pass over another curved forming shoe (23).

5 Claims, 2 Drawing Sheets

TWIN WIRE FORMER

RELATED APPLICATIONS

This is a continuing application of, and hereby incorporates by reference the entire disclosure of, application Ser. No. 08/286,948, filed Aug. 8, 1994 now U.S. Pat. No. 5,500,091, which is a continuing application Ser. No. 08/055,918, filed Apr. 29, 1993, issued Feb. 14, 1995 as U.S. Pat. No. 5,389,206, which is a continuing application Ser. No. 07/773,965, filed as PCT/EP90/01313 Sep. 8, 1990, now abandoned.

BACKGROUND OF THE INVENTION

The present invention relates to a twin-wire former for the production of a fiber web, in particular a paper web, from a fiber suspension. The invention proceeds from the basis of the twin-wire former known from British Patent 1 125 906. The features indicated in the patent include a twin wire former for producing a fiber web and particularly a paper web from a fiber suspension. Two web forming wire belts, in the form of endless loops, travel together to form a twin wire zone. The web travels between and along the path of the wire belts through the twin wire zone. The twin wire zone has three sections and the elements in those three sections are described below. The patent describes features that state, in other words, that the forming of the fiber web from the pulp suspension fed from the headbox takes place exclusively between two wire belts. Thus, there is no so-called single-wire pre-drainage path. In a first section of the twin-wire zone, the two wire belts together form a wedge-shaped inlet slot; a jet of pulp slurry coming from the headbox discharges into it. The jet strikes the two wire belts at a place where they pass over a curved drainage element; in the case of the aforementioned British patent, this is a stationary, curved forming shoe. Its curved wire guide surface is formed of a plurality of strips with drainage slots between them. This forming shoe is followed (in a second section of the twin-wire zone) by a drainage strip arranged in the other wire loop and, behind the latter, by a drainage strip arranged in the first-mentioned wire loop (and formed by a first suction box). Finally, in a third section of the twin-wire zone there are a plurality of stationary drainage elements developed as flat suction boxes.

It has been attempted for decades with twin-wire formers of the known type to produce fiber webs (in particular, paper webs) of the highest possible quality with relatively high operating speeds. Due to the forming of the web between two wires, the result, in particular, is obtained that the final fiber web has substantially the same properties on both sides (little "two-sidedness"). However, it is difficult to obtain as uniform as possible a distribution of the fibers in the final fiber web. In other words, it is difficult to obtain a good "formation" since while the web is formed, there is always the danger that fibers will agglomerate and form flocculations. Therefore, it is attempted to form a jet of pulp slurry which pulp slurry is as free as possible of flocculations in the headbox (for instance, by means of a turbulence producer). It is, furthermore, endeavored so to influence the drainage of the fiber suspension during the web-forming that "reflocculation" is avoided as far as possible or that, after possible flocculation, a "deflocculation" (i.e. a breaking up of the flocculations) takes place.

It is known that a curved drainage element arranged in the first section of the twin-wire zone and, in particular, a stationary curved forming shoe developed in accordance with the aforementioned British Patent 1 125 906 counteracts the danger of reflocculation. This is true also of the drainage strips arranged in the British patent in the second section of the twin-wire zone. Nevertheless, the danger of reflocculation is not completely eliminated in the arrangement according to said British patent. Since the number of drainage strips there is very small, a large part of the web-forming takes place in the region of the following flat-suction boxes. They, to be sure, are of high drainage capacity so that the web-forming can be completed in the region of the last flat suction boxes (i.e. the so-called main drainage zone, in which a part of the fiber material is still in the form of a suspension, terminates in the region of the flat suction box). The flat suction boxes, however, are not able to avoid reflocculation or to break up flocculations which have already occurred.

In order to control these last-mentioned difficulties, a web-forming device known under the name of "Duoformer D" has been developed (TAPPI proceedings 1988 annual meeting, pages 75 to 80). This known web-forming device is part of a twin-wire former which has a single-wire pre-drainage zone. In the twin-wire zone there are provided, in the one wire loop, a plurality of strips which are fixed in position but adjustably supported, namely, on the bottom of a suction box which drains in upward direction. Furthermore, a plurality of resiliently supported strips are provided in the other wire loop. By this resilience of the last-mentioned strips, the following result can be obtained: For example, upon an increase of the amount of suspension entering between the two wire belts, the flexibly supported strips can move away somewhat. In this way, the danger (which is present when only firmly supported strips are used) is eliminated of a backing up taking place in the fiber suspension in front of the strips. Such a backing up could destroy the fiber layers which have been formed up to then on the two wire belts. In other words, with this known web-forming device, a drainage pressure, once established, remains constant due to the resiliently supported strips even upon a change in the amount of suspension fed or upon a change in the drainage behavior of the fiber suspension. Therefore, automatic adaptation of the web-forming device to said changed conditions occurs.

With this known web-forming device, fiber webs of relatively good formation can also be formed. With respect to this, however, the demands have increased considerably recently, so that further improvements are desirable.

SUMMARY OF THE INVENTION

The object of the invention is so to develop a twin-wire of the aforementioned kind that the quality of the fiber web produced is further improved, particularly with respect to its formation (cloudiness), and that the twin-wire former can easily be adapted to different operating conditions (for instance, with regard to quantity and drainage behavior of the fiber suspension).

This object is achieved by the features set forth below. In particular, there is a respective drainage strip above each of the two wire belts in the second section of the twin wire zone, and at least one of the two drainage strips is supported resiliently against the respective wire belt while the other may or may not be resiliently supported, and typically is rigidly supported against the respective wire belt. Preferably, there are at least two of the drainage strips and often more against each of the wire belts. The drainage strips against one belt are offset along the path of the wire belts with respect to the drainage strips against the other belt, providing a zig zag or staggered array, and the drainage strips against at least one of the belts are resiliently supported.

The inventors have found that a combination of known features, namely:

A. Twin-wire former without a single-wire pre-drainage zone or at least without a single-wire pre-drainage zone of any substantial length such as to cause any appreciable pre-drainage B. Start of the drainage in the twin-wire zone at a preferably curved drainage element, for instance on a rotating forming cylinder or, even better, on a curved stationary forming shoe C. Further drainage in the twin-wire zone between strips which are arranged along a "zig-zag" line, the strips which rest against the one wire belt being resiliently supported, leads to an extremely high increase in the quality of the finished fiber web, so that it satisfies even the highest requirements. At the same time, the twin-wire former of the invention is insensitive to changes in the amount of suspension fed and to changes in the drainage behavior of the fiber suspension. Experiments have shown that it is possible by the invention to obtain both a high increase in quality with respect to the formation and also good values with regard to the retention of fillers and fines. In contradistinction to this, in the known double-wire formers it is constantly found that there is a strong reduction in the retention upon an improvement in the formation.

It was, furthermore, found in experiments that in the second section of the twin-wire zone the number of strips can be considerably reduced as compared with the "Duoformer D". However, this number is substantially greater than in the case of the twin-wire former known from British Patent 1 125 906. It is advantageous to increase the distance between adjacent strips as compared with the "Duoformer D". In particular, the drainage strips above each one of the wire belts are of a thickness along the path of the wire belts and the spacing between adjacent strips above each wire belt is a minimum of about three times the strip thickness.

To be sure, from German OS 31 38 133, FIG. 3, a twin-wire former is known the twin-wire zone of which is provided in a first section with a curved stationary drainage element and in a second section with strips arranged along a "zig-zag" line, which strips may also be resiliently supported and there being a relatively large distance between them. However, in that case, in front of the twin-wire zone there is a single-wire pre-drainage zone in which the forming of the web starts initially only in a lower layer of the fiber suspension fed while the upper layer remains liquid and tends very strongly to flocculation. It has been found that these flakes cannot be broken up again to the desired extent in the following twin-wire zone. Another disadvantage is that the twin-wire zone is diverted by a guide roll (**14*b***) behind the second section. This results (due to the so-called table-roll effect) in a further drainage which is uneven over the width of the web and thus in undesired variations in the quality of the web (recognizable, for instance, by disturbing longitudinal stripes).

BRIEF DESCRIPTION OF THE DRAWINGS

Other developments of the invention will be explained below with reference to embodiments which are shown in the drawing. Each of FIGS. 1 to 5 shows-in simplified diagrammatic form-one of the different embodiments.

DETAILED DESCRIPTION OF THE PREFERRED EMBODIMENTS

Figure 1:
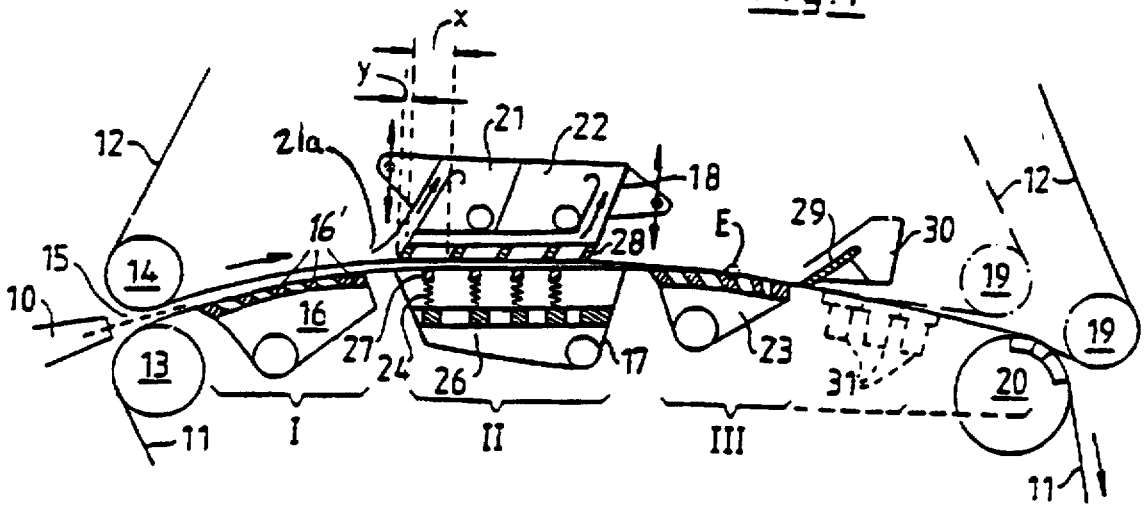

The twin-wire former shown in FIG. 1 has a substantially horizontally extending twin-wire zone; this zone comprises three sections I, II and III arranged one behind the other. The endless wire belts (lower wire 11 and upper wire 12), shown only in part, travel in the direct vicinity of a headbox 10 over, in each case, a breast roll 13 and 14 respectively, so that the two wire belts together form a wedge-shaped entry slot 15 at the start of the twin-wire zone. The jet pulp discharged by the headbox 10 comes into contact with the two wire belts 11 and 12 only at the place where the lower wire 11 in the first section I of the twin-wire zone travels over a stationary curved forming shoe 16. The curved travel surface thereof is formed of several strips 16' with drainage slits present between them. The distance between the two breast rolls 13 and 14 is variable. The forming shoe 16 can be operated with or without vacuum. Additionally, although it is preferable that the forming shoe 16 be curved, a straight forming shoe may also be used in certain situations.

In the second section II of the twin-wire zone, the two wire belts 11 and 12 (with the partially still liquid fiber suspension present between them) travel between a lower drainage box 17 and an upper drainage box 18. In the lower drainage box 17 there are a row of at least two strips 27 (preferably of approximately rectangular cross section) which are pressed from below resiliently against the lower wire 11. For this purpose, they are supported, for instance, on springs 24 (or pneumatic pressure cushions) on a, preferably water-permeable, plate. It is obvious that the force of the springs (or of the pressure prevailing in the pressure cushions) is individually adjustable.

The upper drainage box 18 is suspended on both the front and rear ends on vertically displaceable support elements as indicated diagrammatically by double arrows. On its lower side, there is a row of at least three strips 28 of preferably parallelogram cross section which rest against the upper side of the upper wire 12 and are rigidly attached to the box 18. Above the strips 28, a front vacuum chamber 21 and a rear vacuum chamber 22 are present in the drainage box 18.

Each of the upper strips 28 scrapes off water from the wire 12. Accordingly, the amount of water scraped off decreases in the direction of flow of the wire 12 from strip to strip. The drainage water from each of the strips 28 except the drainage water scraped off by the first strip may be drained away jointly. However, it is disadvantageous to also include the drainage water from the first strip 28 since this generally would disturb the operation of the other strips. Accordingly, a vertical channel **21*a* is positioned in front of the first upper strip 28 to carry away or collect the water scraped off by the first strip 28**.

In the region of the forming shoe 16, a part of the water of the fiber suspension is led off downward; another part penetrates due to the tension of the upper wire 12-upwards through the upper wire and is deflected by the furthest in front of the strips 28 into the front vacuum chamber 21. The water passing upward between the upper strips 28 enters into the rear vacuum chamber 22. The water penetrating between the lower strips 27 through the lower wire 11 is led off downward. Between adjacent upper drainage strips 28 there is a minimum distance X of about three times the thickness Y of the strips. The same is true of the lower resiliently supported strips 27. It is important that each of the strips 27 and 28 lies in the region of a space between two opposite strips so that a "zig-zag" arrangement (i.e. non-opposing relationship) is present. Also, as seen in FIG. 1, the first one of the strips 28 is located upstream of the first one of the strips 27. The two wires 11 and 12 preferably travel on a straight path through section II. Gentle curvature of this section of the path is, however, also possible; see FIGS. 2 and 5. Differing from FIG. 1, the resiliently supported strips could also be arranged in the upper box 18 and the firmly supported strips in the lower box 17. In the third section III of the twin-wire zone, both wire belts 11 and 12 travel over another preferably curved forming shoe 23 which (as shown) is arranged preferably in the lower wire loop 11. Behind it, an additional strip 29 with vacuum chamber 30 can be arranged in the loop of the upper wire 12. Furthermore, flat suction boxes 31 can be present in the loop of the lower wire. There (as is shown by dash-dot lines) the upper wire 12 can be separated by means of a guide roll 19 from the lower wire 11 and from the fiber web formed. Lower wire and fiber web then travel over a wire suction roll 20. The guide roll 19 can, however, also lie further back, so that the upper wire 12 is separated from the lower wire 11 only on the wire suction roll 20.

It is important that two drainage boxes 17 and 18 with the alternately resiliently and firmly supported ledge strips 27 and 28 lie not in the front or the rear sections but in the middle section II of the twin-wire zone, since only here can they develop their full effect, namely, intensive drainage of the fiber suspension fed while retaining the fine flocculation-free fiber distribution. This is achieved in the manner that the corresponding wire belt is imparted a slight (scarcely visible) deflection on each strip so that turbulence is constantly produced in the still liquid part of the fiber pulp. For success it is, however, also decisive that previously, in section I, a known pre-drainage towards both sides has already taken place and that this also takes place with the greatest possible retention of the flocculation-free condition of the fiber suspension.

For this two-sided pre-drainage, a stationary preferably curved forming shoe is provided in the first section I of the twin-wire zone (in accordance with FIGS. 1 and 3–5) whenever it is a question of satisfying the highest quality demands with respect to the formation. This effect of the forming shoe is due to the fact that at least the one wire belt travels polygonally from strip to strip, each strip not only leading water away but also producing turbulence in the pulp which is still liquid. With such a forming shoe, it is, however, difficult at times to obtain a stable operating condition upon the starting of the paper machine. Therefore, it may be advantageous to provide a known forming roll 40 in accordance with FIG. 2 in Section I instead of the stationary forming shoe and the breast roll lying in front of it. This possibility will be utilized when, in particular, the highest productivity is demanded from the paper manufacturing machine.

In the third section III, the aforementioned strip 29 can serve either solely to lead away water upwards or, in addition, for the further production of turbulence (for further improvement in quality). The latter is possible if a part of the fiber pulp is still in liquid condition at this place.

Figure 2:
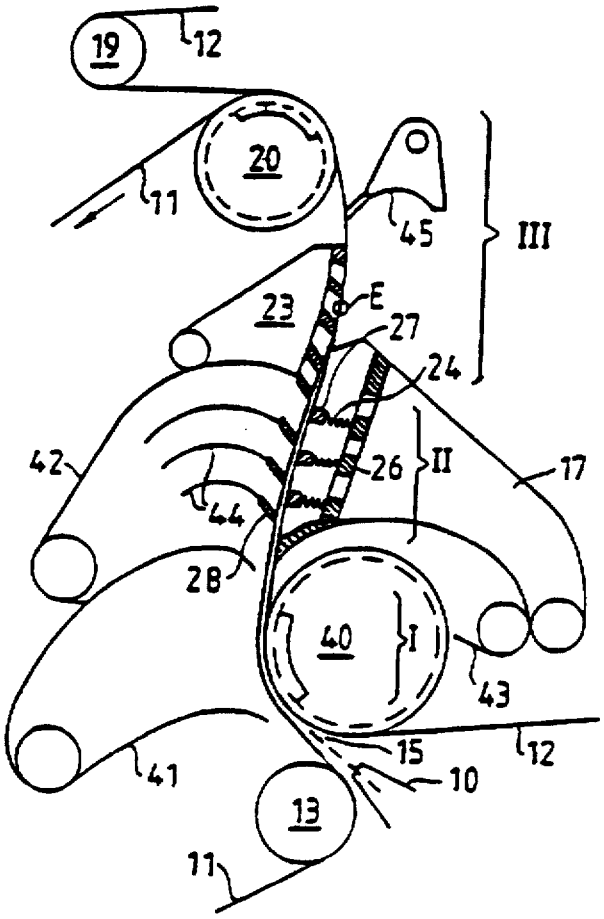
Figure 3:
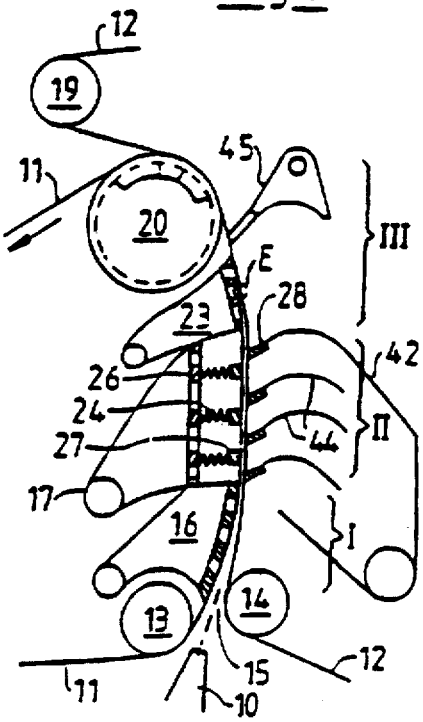

In FIGS. 1 to 3, the distance between the two wires 11 and 12 in the twin-wire zone has been shown greatly exaggerated. By this, it is intended to make it clear that the two wires 11 and 12 converge towards each other over a relatively long path within the twin-wire zone. This makes it clear that the process of web-forming on the first forming shoe 16 (in Section I) commences relatively slowly and is completed only in Section III. In this connection, the end of the main drainage zone in which the two wires converge towards each other (and thus, the end of the web-forming process) can lie approximately in the center of the wrapping zone of the second forming shoe 23, as is indicated, merely by way of example, in FIGS. 1 to 3. The end of the wire convergence is symbolically indicated there by the point E; the solids content of the paper web has reached there approximately the value of 8%. This point can, however, also lie, for instance, on one of the flat suction boxes 31. Behind this point, it is attempted further to increase the solids content, if possible even before the separation of the two wires. One goal is, namely, for the separation of the wires to take place with the highest possible solids content of the web so that as few fibers as possible are torn out of the web upon the separation. The nature and number of the drainage elements necessary for this within the twin-wire zone may, however, differ greatly and is dependent, among other things, on the type of paper and the raw-material components thereof, as well as on the operating speed.

The embodiments shown in FIGS. 2 and 3 differ from the others primarily by the fact that the twin-wire zone rises substantially vertically upward in the direction of travel of the wires. In this way, the removal of the water withdrawn from the fiber suspension is simplified since the water can be discharged relatively uniformly towards both sides. No vacuum chambers are required in particular in the central section II of the twin-wire zone. To be sure, the forming roll 40 of FIG. 2 is, as a rule, developed as a suction roll. The forming shoes 16, 23, particularly those arranged in the third section III, can, if necessary, be provided with a suction device.

Further elements of the twin-wire former shown in FIG. 2 are water-collection containers 41, 42 and 43, guide plates 44 associated with the fixed strips 28, and a water removal strip 45. The other elements are provided with the same reference numbers as the corresponding elements in FIG. 1. The same is true with regard to FIG. 3. One possible modification of FIG. 3 can consist therein that, instead of the wire suction roll 20, a forming roll is provided, and instead of the guide roll 19 the wire suction roll. A similar arrangement is known from German Utility Model 88 06 036 (Voith File: P 4539). Aside from this exception and aside from the embodiment according to FIG. 2 (with forming roll 40), the invention will, however, be used whenever possible-so to design the twin-wire former that the relatively expensive forming roll (as to purchase and operation) can be dispensed with. Thus, as a rule, the wire suction roll 20 is present as the sole suction roll. Furthermore, in all embodiments of the invention it can be seen to it that no guide roll which deflects the twin-wire zone (and has the above-mentioned injurious table-roll effect) is present.

Figure 4:
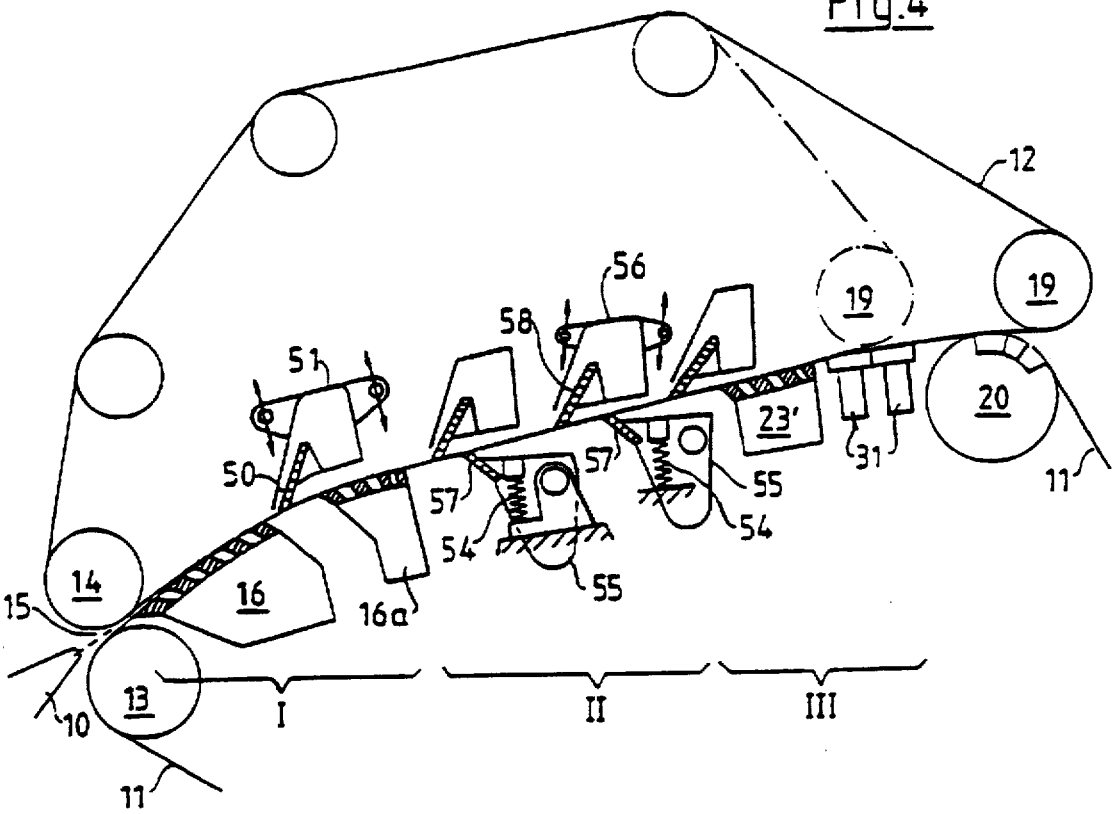

The embodiment of FIG. 4 differs from FIG. 1 among other things by the fact that, in the first section I of the twin-wire zone, a second curved stationary forming shoe **16*a* is arranged in the loop of the lower wire 11 behind and spaced from a first curved stationary forming shoe 16. Furthermore, in the loop of the upper wire 12 in the region between the two stationary forming shoes 16 and 16*a* there is provided an individual strip 50 which in known manner is part of a vacuum chamber 51. This vacuum chamber 51, similar to the upper drainage box 18 of FIG. 1, is suspended on its front and rear ends in vertically displaceable mounts. In this way, both the depth of penetration of the strip 50 into the path of travel of the upper wire 12 as well as the angle of attack of the strip 50 can be varied. With slight depth of penetration, the strip 50 serves solely for removal of water, while with greater depth of penetration it serves, in addition, for the production of turbulence in the suspension and, thus, for improvement of the formation. By the presence of two separate forming shoes 16 and 16*a*, the pre-drainage on both sides is temporarily interrupted; it is only continued after the strip 50 has removed from the upper wire 12 the water which has penetrated upward on the first forming shoe 16**. In this way, higher operating speeds are possible.

Another difference from FIG. 1 is that, in the second section II of the twin-wire zone, the lower, flexibly supported strips 57 and the upper, firmly supported strips 58 are developed as individual strips. This means that each strip has its own supporting body 55/56. The lower strip-supporting bodies 55 are swingably mounted, the strip 57 being pressed resiliently by the force of springs 54 against the bottom of the lower wire 11. The supporting body 56 of each of the upper strips 58 is developed as vacuum chamber in the same way as that of the strip 50. The suspension of these vacuum chambers 56 corresponds to that of the vacuum chamber 51. It is important that each of the strips 57 and 58 rest with a given force of application (corresponding to the suspension pressure) against its wire belt 11 or 12. The strips 57 and 58 are adjusted in such a manner that a slight deflection of the wire belts takes place preferably on each strip. Due to the resilient supporting of the lower strips 57, the adjustment, once effected, is insensitive to changes in the quantity or quality of pulp, so that no backing up takes place in front of the strips and, nevertheless, an effective introduction of turbulence forces into the fiber suspension takes place. In contradistinction to FIGS. 1 to 3, there is the possibility of adjusting each one of the strips 57/58 individually with respect to position in height and inclination relative to the travel path of the wire. In this way, one can even better control the quality of the paper produced, with respect to both the formation and the nature of its surface (printability). Differing from FIG. 4, the upper strips 58 could be supported resiliently and the lower strips 57 stationary. Another alternative could consist therein that not only the upper strips 58 but also the lower strips 57 are fastened in vertically displaceable mounts (as shown on the vacuum chamber 51). In such case, the springs 54 might possibly be eliminated.

Another difference between FIGS. 1 and 4 resides in the fact that in FIG. 4 the twin-wire zone rises in the direction of travel of the wires upwards with an inclination of, on the average, about 20° with respect to the horizontal. In this way, it is possible to keep the entire height of the twin-wire former relatively slight. In the third section III of the twin-wire zone, a flat forming shoe 23' is provided rather than a curved one, differing from FIG. 1. The separation of the upper wire 12 from the lower wire and the fiber web formed can take place, as in FIG. 1, on one of the flat suction boxes 31. Instead of this, however, the upper wire 12 can also be conducted up to the wire suction roll 20. There, as shown, it can wrap around a small part (or, alternatively, a larger part) of the circumference of the wire suction roll and then be returned via the reversing roll 19.

Figure 5:
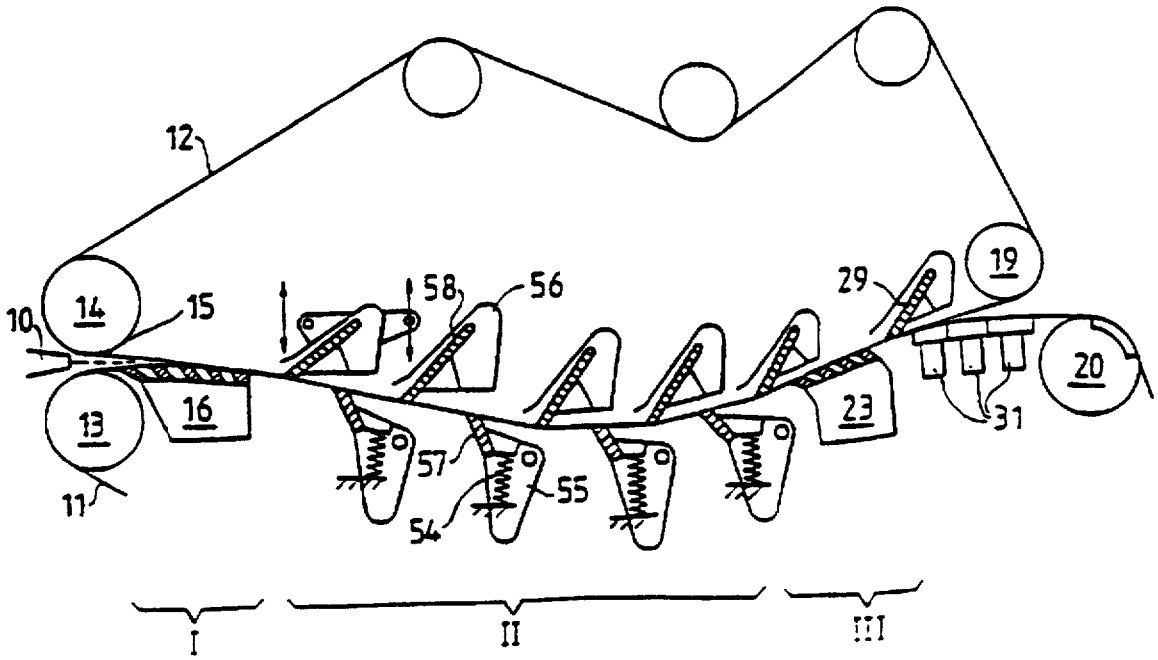

In the embodiment shown in FIG. 5, the twin-wire zone, as a whole, extends substantially in horizontal direction. The individual elements are substantially the same as in the embodiment of FIG. 4. However, there is the difference that the drainage strips 57 and 58 lying in the second section II of the twin-wire zone are arranged along a downwardly curved path of the twin-wire zone. Accordingly, an upwardly curved forming shoe 16, 23 is provided in the first section I and in the third section III of the twin-wire zone. This embodiment is advisable, in particular, for the modernizing of existing Fourdrinier paper machines.

The embodiments shown have the feature in common that, in the second section II of the twin-wire zone, there are present preferably n flexibly supported strips 27/57 and n+1 rigidly supported strips. However, it is also possible to make the number of flexibly supported strips equal to or greater by one than the number of rigidly supported strips. Instead of a rigidly supported strip, a feed or discharge edge of a drainage box can also be provided. The minimum number n of flexibly supported strips is two (see FIG. 4). However, three or four flexibly supported strips are preferred.

What is claimed is:

1. A twin-wire former for the production of a paper web from a fiber suspension, the twin wire former comprising:

first and second web forming wire belts, means for directing the wire belts to travel along a path together for forming a twin wire zone of the twin wire former, with the web between the wire belts as the wire belts travel along the path through the twin wire zone, neither wire belt defining a single wire predrainage zone;

each wire belt forming an endless loop;

the twin wire zone having a first section which includes a first drainage element at the start of the path through the twin wire zone, means for supporting the belts for forming a wedge shaped entrance slot into the first section, a fiber suspension supplying headbox having an outlet placed and directed for delivering fiber suspension from the headbox to the wedge shaped entrance slot of the first section of the twin wire zone;

the twin wire zone having a second section following the first section along the path of the belts through the twin wire zone in the second section, a plurality of first drainage strips are positioned for contacting the first wire belt; in the second section, a plurality of second drainage strips are positioned within the loop of the second wire belt and are for contacting the second wire belt; the first strips being shifted in position along the path of the wire belts with respect to the second strips so that the first and second strips are offset and in a non-opposing relationship; first support means for resiliently supporting the first drainage strips against the respective wire belt that the strips contact;

second support means supporting the second drainage strips rigidly against the second wire belt;

first means for collecting the water drained from the fiber suspension by the most upstream, one of the drainage strips;

second means separate from the first means for collecting the water drained from the fiber suspension by all of the other drainage strips; and the twin wire zone having a third section following the second section along the path of the wire belts through the twin wire zone; a second drainage element in the third section for being engaged by one of the wire belts as the wire belts travel over the second drainage element, the twin wire zone being free of rolls which deflect the twin wire zone.

2. A twin-wire former for the production of a paper web from a fiber suspension, the twin wire former comprising:

first and second web forming wire belts, means for directing the wire belts to travel along a path together for forming a twin wire zone of the twin wire former, with the web between the wire belts as the wire belts travel along the path through the twin wire zone, neither wire belt defining a single wire predrainage zone;

each wire belt forming an endless loop;

the twin wire zone having a first section which includes a first drainage element at the start of the path through the twin wire zone, means for supporting the belts for forming a wedge shaped entrance slot into the first section, a fiber suspension supplying headbox having an outlet placed and directed for delivering fiber suspension from the headbox to the wedge shaped entrance slot of the first section of the twin wire zone;

the twin wire zone having a second section following the first section along the path of the belts through the twin wire zone; in the second section, a plurality of first drainage strips are positioned for contacting the first wire belt; in the second section, a plurality of second drainage strips are positioned within the loop of the second wire belt and are for contacting the second wire belt; the first strips being shifted in position along the path of the wire belts with respect to the second strips so that the first and second strips are offset and in a non-opposing relationship; first support means for resiliently supporting the first drainage strips against the respective ware belt that the strips contact;

second support means supporting the second drainage strips rigidly against the second wire belt;

first means for collecting the water drained from the fiber suspension by the most upstream one of the drainage strips;

second means separate from the first means for collecting the water drained from the fiber suspension by all of the other drainage strips; and the twin wire zone having a third section following the second section along the path of the wire belts through the twin wire zone: a second drainage element in the third section for being engaged by one of the wire belts as the wire belts travel over the second drainage element, the twin wire zone being free of any forming rolls.

3. A twin-wire former for the production of a paper web from a fiber suspension, the twin wire former comprising:

first and second web forming wire belts, means for directing the wire belts to travel along a path together for forming a twin wire zone of the twin wire former, with the web between the wire belts as the wire belts travel along the path through the twin wire zone, neither wire belt defining a single wire predrainage zone;

each wire belt forming an endless loop;

the twin wire zone having a first section which includes a first drainage element at the start of the path through the twin wire zone, means for supporting the belts for forming a wedge shaped entrance slot into the first section, a fiber suspension supplying headbox having an outlet placed and directed for delivering fiber suspension from the headbox to the wedge shaped entrance slot of the first section of the twin wire zone;

the twin wire zone having a second section following the first section along the path of the belts through the twin wire zone; in the second section, a plurality of first drainage strips are positioned within the loop of the first wire belt and are for contacting the first wire belt; in the second section, a plurality of second drainage strips are positioned within the loop of the second wire belt and are for contacting the second wire belt; the first strips being shifted in position along the path of the wire belts with respect to the second strips so that the first and second strips are offset and in a non-opposing relationship; first support means for resiliently supporting the first drainage strips against the respective wire belt that the strips contact, the last one of the second drainage strips being located downstream of the last one of the first drainage strips;

second support means supporting the second drainage strips rigidly against the second wire belt;

the twin wire zone having a third section following the second section along the path of the wire belts through the twin wire zone; a second drainage element in the third section for being engaged by one of the wire belts as the wire belts travel over the second drainage element, the second drainage element having an open surface to enable water to be drained through the wire belt in contact therewith; and the twin wire zone being free of rolls which deflect the twin wire zone.

4. A twin-wire former for the production of a paper web from a fiber suspension, the twin wire former comprising:

first and second web forming wire belts, means for directing the wire belts to travel along a path together for forming a twin wire zone of the twin wire former, with the web between the wire belts as the wire belts travel along the path through the twin wire zone, neither wire belt defining a single wire predrainage zone;

each wire belt forming an endless loop;

the twin wire zone having a first section which includes a first drainage element at the start of the path through the twin wire zone, means for supporting the belts for forming a wedge shaped entrance slot into the first section, a fiber suspension supplying headbox having an outlet placed and directed for delivering fiber suspension from the headbox to the wedge shaped entrance slot of the first section of the twin wire zone;

the twin wire zone having a second section following the first section along the path of the belts through the twin wire zone; in the second section, a plurality of first drainage strips are positioned within the loop of the first wire belt and are for contacting the first wire belt; in the second section, a plurality of second drainage strips are positioned within the loop of the second wire belt and are for contacting the second wire belt; the first strips being shifted in position along the path of the wire belts with respect to the second strips so that the first and second strips are offset and in a non-opposing relationship; first support means for resiliently supporting the first drainage strips against the respective wire belt that the strips contact, the last one of the second drainage strips being located downstream of the last one of the first drainage strips;

second support means supporting the second drainage strips rigidly against the second wire belt;

the twin wire zone having a third section following the second section along the path of the wire belts through the twin wire zone; a second drainage element in the third section for being engaged by one of the wire belts as the wire belts travel over the second drainage element; and the twin wire zone being free of any forming rolls.

5. A twin-wire former for the production of a paper web from a fiber suspension, the twin wire former comprising:

first and second web forming wire belts, means for directing the wire belts to travel along a path together for forming a twin wire zone of the twin wire former, with the web between the wire belts as the wire belts travel along the path through the twin wire zone, neither wire belt defining a single wire predrainage zone;

each wire belt forming an endless loop;

the twin wire zone having a first section which includes a single first drainage element at the start of the path through the twin wire zone, means for supporting the belts for forming a wedge shaped entrance slot into the first section, a fiber suspension supplying headbox having an outlet placed and directed for delivering fiber suspension from the headbox to the wedge shaped entrance slot of the first section of the twin wire zone; said single first drainage element in the first section being a single forming roll having an open surface to enable drainage of water from the fiber suspension and being curved along the path of the belts through the twin wire zone, the single forming roll being engaged by one of the wire belts for curving the path of the belts around the single forming roll after the entrance of the suspension into the entrance slot;

the twin wire zone having a second section following the first section along the path of the belts through the twin wire zone; in the second section, a plurality of first drainage strips are positioned within the loop of the first wire belt and are for contacting the first wire belt; in the second section, a plurality of second drainage strips are positioned within the loop of the second wire belt and are for contacting the second wire belt; the first strips being shifted in position along the path of the wire belts with respect to the second strips so that the first and second strips are offset and in a non-opposing relationship; first support means for resiliently supporting the first drainage strips against the respective wire belt that the strips contact;

second support means supporting the second drainage strips rigidly against the second wire belt; and means for supplying a vacuum in the area of the second drainage strips;

the twin wire zone having a third section following the second section along the path of the wire belts through the twin wire zone; a second drainage element in the third section, for being engaged by one of the wire belts as the wire belts travel over the second drainage element, the second drainage element having an open surface to enable water to be drained through the wire belt in contact therewith; and the twin wire zone apart from said single forming roll being free of rolls which deflect the twin wire zone.

* * * * *

US005718805C1

(12) EX PARTE REEXAMINATION CERTIFICATE (6698th)

United States Patent

Egelhof et al.

(10) Number: US 5,718,805 C1

(45) Certificate Issued: Mar. 17, 2009

(54) TWIN WIRE FORMER

(75) Inventors: Dieter Egelhof, Heidenheim (DE); Klaus Henseler, Heidenheim (DE); Werner Kade, Neenah, WI (US); Albrecht Meinecke, Heidenheim (DE); Wilhelm Wanke, Heidenheim (DE); Hans-Jurgen Wulz, Heidenheim (DE); Rudolf Bück, Heidenheim (DE); Else Bück, legal representative, Heidenheim (DE)

(73) Assignee: Voith Paper GmbH & Co. KG, Heidenheim (DE)

Reexamination Request:
No. 90/008,826, Aug. 24, 2007

Reexamination Certificate for:

| | |
|---|---|
| Patent No.: | **5,718,805** |
| Issued: | **Feb. 17, 1998** |
| Appl. No.: | **08/556,769** |
| Filed: | **Nov. 2, 1995** |

Related U.S. Application Data

(63) Continuation of application No. 08/286,948, filed on Aug. 8, 1994, now Pat. No. 5,500,091, which is a continuation of application No. 08/055,918, filed on Apr. 29, 1993, now Pat. No. 5,389,206, which is a continuation of application No. 07/773,965, filed as application No. PCT/EP90/01313 on Sep. 8, 1990, now abandoned.

(30) Foreign Application Priority Data

| | | |
|---|---|---|
| Aug. 22, 1989 | (DE) | 3927597 |
| Aug. 9, 1990 | (EP) | PCT/EP90/01313 |

(51) Int. Cl.
*D21F 9/00* (2006.01)

(52) U.S. Cl. ..... 162/301; 162/300

(58) Field of Classification Search ..... None
See application file for complete search history.

(56) References Cited

U.S. PATENT DOCUMENTS

| | | | |
|---|---|---|---|
| 3,056,719 | A | 10/1962 | Webster |
| 3,215,594 | A | 11/1965 | Baxter, Jr. et al. |
| 3,438,854 | A | 4/1969 | Means |
| 3,582,467 | A | 6/1971 | Gustafson et al. |
| 3,726,758 | A | 4/1973 | Parker et al. |
| 3,772,145 | A | 11/1973 | Notbohm |
| 3,994,774 | A | 11/1976 | Halme et al. |
| 4,425,187 | A | 1/1984 | Armstrong et al. |
| 4,532,008 | A | 7/1985 | Creagan et al. |
| 4,551,204 | A | 11/1985 | Holik et al. |

(Continued)

FOREIGN PATENT DOCUMENTS

| | | |
|---|---|---|
| DE | 35 03 242 A1 | 3/1956 |
| DE | 3138133 | 3/1983 |
| DE | 3329833 | 3/1984 |
| DE | 3321406 | 12/1984 |
| DE | 3628282 | 2/1988 |

(Continued)

OTHER PUBLICATIONS

Jong J. and Wildfong, V. "Effect of Counter Blades on Paper Properties: Newsprint." 2006 TAPPI Papermakers Conference Apr. 24, 2006–Apr. 28, 2006, Atlantic Marriott Marquis (2006), 1–11 (26 pages total).

(Continued)

*Primary Examiner*—Terrence R Till

(57) ABSTRACT

In a twin-wire former for the production of a paper web, two wire belts (11 and 12) together form a twin-wire zone which is divided into three sections (I, II and III). In the first section (I) the two wires (11, 12) travel over a curved forming shoe (16), or a forming roll (40). They form there a wedge-shaped inlet slot (15) with which a headbox (10) is directly associated. In the second section (II), several resiliently supported strips (27) rest against the lower wire (11) and between each of said strips (27) a rigidly mounted strip (28) rests against the upper wire (12). In the third section (III) both wire belts (11, 12) pass over another curved forming shoe (23).

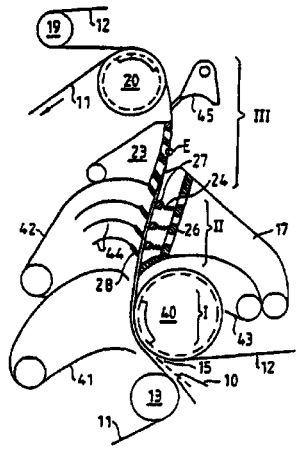

U.S. PATENT DOCUMENTS

| | | | |
|---|---|---|---|
| 4,557,802 | A | 12/1985 | Waris |
| 4,609,435 | A | 9/1986 | Tissari |
| 4,769,111 | A | 9/1988 | Nevalainen et al. |
| 4,865,692 | A | 9/1989 | Kade et al. |
| 4,917,766 | A | 4/1990 | Koivuranta et al. |
| 4,925,531 | A | 5/1990 | Koski |
| 4,999,087 | A | 3/1991 | Ebihara et al. |
| 5,074,964 | A | 12/1991 | Partanen |
| 5,078,835 | A | 1/1992 | Schiel et al. |
| 5,185,064 | A | 2/1993 | Nyman |
| 5,389,206 | A | 2/1995 | Buck et al. |
| 5,500,091 | A | 3/1996 | Buck et al. |
| 5,718,805 | A | 2/1998 | Egelhof et al. |
| 5,853,544 | A | 12/1998 | Egelhof et al. |
| 5,972,168 | A | 10/1999 | Egelhof et al. |

FOREIGN PATENT DOCUMENTS

| | | | |
|---|---|---|---|
| DE | 8806036.5 | | 8/1988 |
| DE | 3927597 | | 2/1991 |
| EP | 0296135 | | 10/1990 |
| EP | 0397430 | A1 | 11/1990 |
| EP | 0289445 | | 1/1991 |
| EP | 0306759 | | 8/1991 |
| EP | 0397430 | B2 | 6/1998 |
| GB | 1125906 | | 10/1964 |
| GB | 2 174 119 | A | 3/1965 |
| GB | 1125906 | | 9/1968 |
| WO | 86/04368 | | 7/1986 |
| WO | 91/02842 | | 3/1991 |

OTHER PUBLICATIONS

J. D. Sinkey et al., IPC Technical Paper Series, No. 180, Quality Comparisons of Twin–Wire and Fourdrinier Papers, The Institute of Paper Chemistry, Appleton, Wisconsin, cover and pp. 1–9 (Jun. 1986).

John D. Peel, Paper Science and Paper Manufacture, Angus Wilde Publications, Inc., Vancouver, pages including cover, copyright page and p. 150 (1999).

Herbert Holik, Handbook of Paper and Board, Wiley–VCH Verlag Gmbh & Co., KGaA, 2006, pp. 271–272.

Wildfong and Shands, "A Twin Wire Former Rebuild Option for Improved Formation and Drainage," 1998 Engineering Conference TAPPI Proceedings, p. 53–69 (17 pages).

Wildfong, Shands, Ronning, Condon, Bouchard and Lajoie, "Evaluation of Gap Forming Rebuild Options: Part I—Quality Improvements with Maximum Reuse of Existing Drainage Components," PAPTAC 94th Annual Meeting: Paper Machine Technology Session, Feb. 6, 2008 (11 pages).

U.S. Appl. No. 90/008,921, filed Aug. 24, 2007, Egelhof et al.

U.S. Appl. No. 90/008,826, filed Aug. 24, 2007, Egelhof et al.

U.S. Appl. No. 90/008,931, filed Nov. 16, 2007, Egelhof et al.

U.S. Appl. No. 90/008,932, filed Nov. 16, 2007, Buck et al.

U.S. Appl. No. 90/008,924, filed Nov. 16, 2007, Buck et al.

Tappi Press "1989 Twin Wire Seminar". Washington Hilton, Washington, DC. Apr. 12–14, 1989, pp. iii, 103–114.

Gary A. Smook , Handbook of Pulp & Paper Terminology, A Guide To Industrial and Technological Usage, Angus Wilde Publications, 1990, pp. 205–206.

John R. Lavigne, Pulp & Paper Dictionary, from the publishers of Pulp & Paper and Pulp & Paper International, 1986, p. 372–373 and 413.

Schaffrath et al. "Vertical Forming Machine Gives Symmetrical Sheet Structure." (May 1965) TAPPI 48(5): 50A–52A.

"Paper Machine Felts." Ed. Woodside, L.M. (1967) Albany Felt Company, Albany, NY: Chapter IV, pp. 17–22.

"Paper Machine Felts and Fabrics" Eds. Bergsma, et al. (1976) Albany International Corp., Albany, NY: Chapter 4, pp. 35–43.

Parker, J.D. "The Sheet Forming Process." (1972) TAPPI Fourth Printing: 80–89.

Baumann, W. "DUOFORMER–D® —A New Approach to Top Wire Forming." (1988) TAPPI Proceedings—Annual Meeting: 75–80.

Norman, B. "Principles of twin–wire forming." Svensk Papperstidning (1979) 82(11), 330–336.

International Preliminary Examination Report and International Search Report from the above–noted family member PCT/EP90/01313.

Schaffrath, P.M. and Marshall, S. G. "Vertical Forming Machine Gives Symmetrical Sheet Structure." (May 1965) Tappi 48(5): 50A–52A.

"Paper Machine Felts." Ed. Woodside, L.M. (1967) Albany Felt Company, Albany, NY: Chapter IV, pp. 17–22.

"Paper Machine Felts and Fabrics" Eds. Bergsma, et al. (1976) Albany International Corp., Albany, NY: Chapter 4, pp. 35–43.

Parker, J.D. "The Sheet Forming Process." (1972) TAPPI Fourth Printing: 80–89.

Baumann, W. "DUOFPRMER–D® —A New Approach to Top Wire Forming." (1988) TAPPI Proceedings—Annual Meeting: 75–80.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *